US005109917A

United States Patent [19]

Ripley

[11] Patent Number: 5,109,917

[45] Date of Patent: May 5, 1992

[54] MAINTENANCE ARRANGEMENT FOR A FURNACE

[75] Inventor: Fred W. Ripley, Perkasie, Pa.

[73] Assignee: Vacuum Furnace Systems Corporation, Souderton, Pa.

[21] Appl. No.: 667,269

[22] Filed: Mar. 11, 1991

[51] Int. Cl.[5] ..... F28D 1/06

[52] U.S. Cl. ..... 165/75; 165/78; 165/122

[58] Field of Search ..... 165/73-75, 165/122, 78

[56] References Cited

U.S. PATENT DOCUMENTS

| | | | |
|---|---|---|---|
| 1,029,631 | 6/1912 | Quiggin | 165/75 |
| 2,049,153 | 7/1936 | Bronson | 165/74 X |
| 2,110,024 | 3/1938 | Miller | 165/75 X |
| 2,433,655 | 12/1947 | Zoppola | 165/74 X |
| 2,797,069 | 6/1957 | Layton | 165/74 |
| 2,961,220 | 11/1960 | Packard | 165/75 |
| 3,305,002 | 2/1967 | Leonard, Jr. et al. | 165/74 X |
| 4,637,347 | 1/1987 | Troy | 122/20 A |

*Primary Examiner*—Allen J. Flanigan
*Attorney, Agent, or Firm*—William F. Cleaver

[57] ABSTRACT

The present arrangement includes a removable, sealable plate located over a port in the side of a vacuum furnace chamber, which port lies opposite a heat exchange device. The heat exchanger is mounted on guide devices to enable it to be slideably withdrawn from the furnace chamber without causing injury to any other furnace parts located within the vacuum furnace chamber, such as the hot zone. The removable, sealable plate has major apertures therethrough to permit coolant pipes (eq. water pipes) to pass therethrough. Such feedthrough coolant pipes are sealed to provide integrity for the vacuum condition of the furnace. In addition the present arrangement includes a second sealable, removable plate located on a bonnet device which houses a fan motor. The grease fittings for such a fan motor are elongated and are accessible when the second plate is removed.

4 Claims, 2 Drawing Sheets

MAINTENANCE ARRANGEMENT FOR A FURNACE

BACKGROUND OF THE DISCLOSURE

In vacuum furnace technology, it is well understood that after a workpiece has been heated to a prescribed temperature and held thereat for a predetermined period, the desired microstructure for the workpiece is very often dependent on a quick quench. Quick quenches are accomplished in a number of different ways. At least one popular way includes providing a heat exchanger which accepts quenches gas from the hot zone. The heat exchanger removes heat from the quench gas, which has passed over the workpiece, before such gas is returned to the hot zone to remove more heat from the workpiece.

In the prior art such heat exchangers have been and are located at the end of the hot zone. In the event such a heat exchanger was, or is, in need of maintenance, the hot zone has been, or is, removed. In the course of removing a hot zone, generally, a good deal of damage is done because there are many parts of a hot zone which become brittle with use. Such parts easily break in response to being moved, or in response to unscrewing the many sections that are secured to the furnace chamber. Other parts (i.e. other than the heat exchanger) of the internal system require maintenance, such as the bearings of the fan motor which drives the fan that removes the quench gas from the hot zone. In the prior art if a motor bearing required lubrication, sections of the furnace had to be removed if they were in alignment with the fan motor, i.e. located between the motor and the door of the furnace.

The present configuration is the first arrangement, known to the inventors, wherein the heat exchanger itself and its accessibility makes the maintenance easily accomplished. The formation of the heat exchanger per se and its proximity to a removable, sealable port cover does not require the user to remove the hot zone. In addition the present arrangement is the first arrangement, known to the present applicants, which permits the user to readily lubricate the bearings of a fan motor.

SUMMARY OF THE DISCLOSURE

The present system includes a heat exchanger which is formed to be movable, substantially orthogonally, with respect to the axis of the hot zone of a vacuum furnace. The present arrangement further includes a first port on the side of the vacuum furnace chamber wall. The first port opens into the path of the heat exchanger should the heat exchanger be moved orthogonally. The first port has a cover, which is removable and which is formed to seal the port to insure the integrity of the vacuum condition in the furnace. In addition the present device includes extensions of the lubrication fittings attached to the fan motor. The extensions are located opposite a second port, which also has a removable cover which seals the port when the cover is secured to the chamber wall. Accordingly the cover of the second port can be removed and the bearings of the fan motor can be readily lubricated without disturbing the other structural parts of the furnace.

DETAILED DESCRIPTION

The objects and features of the present invention will be better understood when the following description is studied in conjuction with the drawings wherein.

Figures 1, 3:
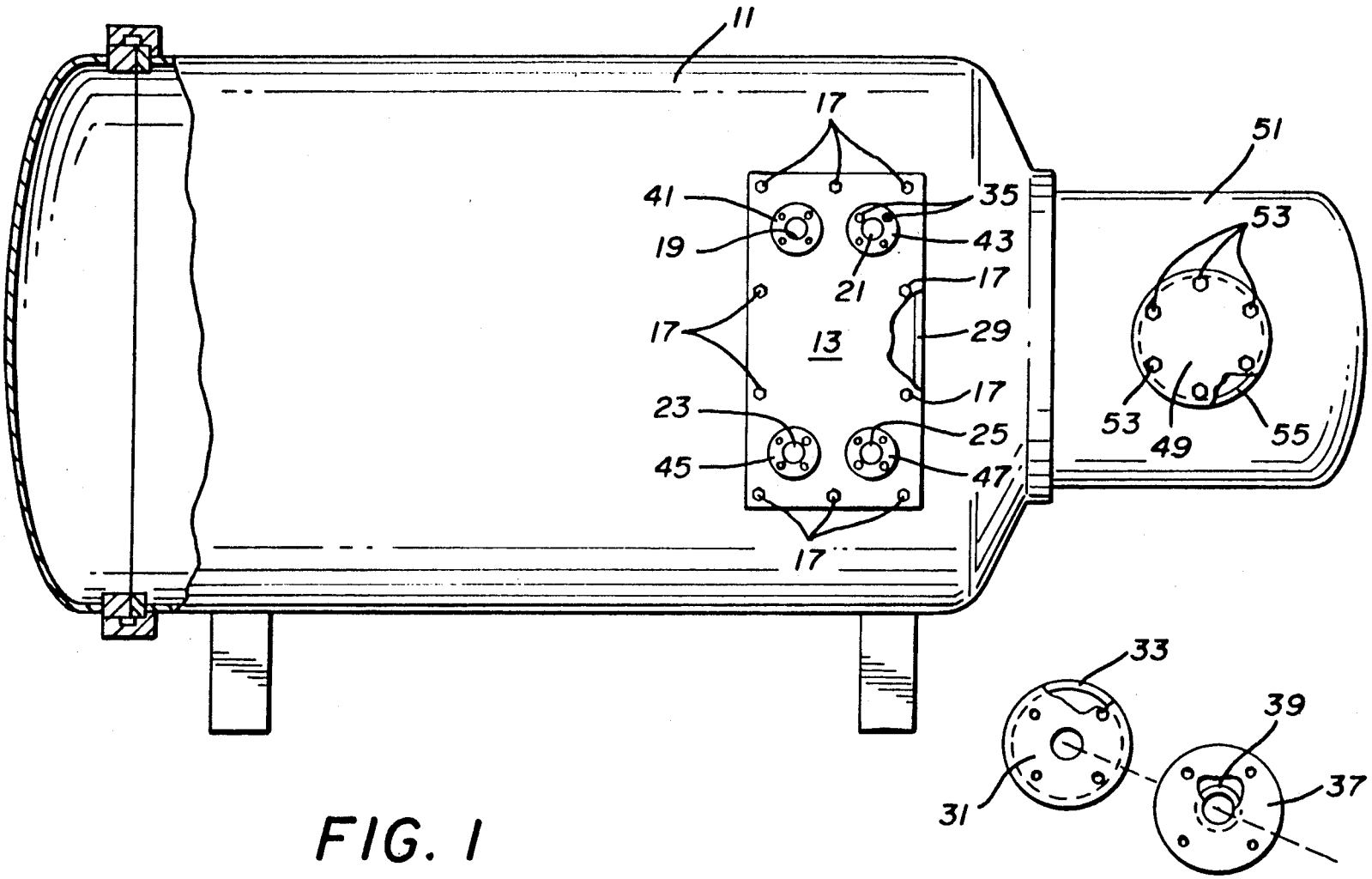
FIG. 1 is a pictorial schematic depicting the vacuum furnace chamber with a cover closing a first port and a cover closing a second port.
FIG. 3 is an enlarged and exploded view of one of the flange assemblies located on the cover over the first port.

Consider FIG. 1. In FIG. 1 there is shown a vacuum furnace chamber 11. On the side of the chamber there is located a cover plate 13, which covers a port 15 (shown in FIG. 2). The cover plate 13 is secured to the chamber wall by the bolts 17. The cover plate 13 has four major apertures therein through which there are located pipes 19, 21, 23 and 25. The pipes are paired to carry water (or some other coolant) into and out of the heat exchanger 27, shown in FIG. 2. The pipes 19 and 23 carry water into and out of the first section of the heat exchanger. The first section of the heat exchanger, in a preferred embodiment, is fabricated from stainless steel. Stainless steel is employed in the first section because the quench gas which leaves the hot zone is at a very high temperature. Stainless steel is capable of withstanding high temperatures. The pipes 21 and 25 carry water into and out of the second section of the heat exchanger. The second section of the heat exchanger is fabricated from copper. Copper is a better heat conductor and it is capable of withstanding the lower temperatures of the quench gas which temperatures have been reduced by exposure to the stainless steel section.

The plate 13 is shown in FIG. 1 as "broken away" to show the gasket 29. The gasket 29 is located around the periphery of the plate 13 so that when the plate 13 is secured to the chamber wall there is a seal along the edge of plate 13 and the integrity of the vacuum condition of the furnace can be maintained.

Each of the water pipes 19, 21, 23 and 25 is respectively surrounded by a different flange assembly 41, 43, 45 and 47. The flange assemblies are better appreciated if we consider FIG. 3. The flange assembly is shown in an enlarged and exploded view in FIG. 3. In FIG. 3, the rearward flange 31 includes O-ring 33. The O-ring 33, when squeezed down by the bolts shown (such as bolts 35 in FIG. 1), will form a seal to prevent leaks between the flange assembly and the chamber wall. The forward flange 37, includes O-ring 39, which when squeezed down by the bolts shown (such as bolts 35 in FIG. 1) will form a seal around the periphery of the water pipe. The flanges 31 and 37 are coupled together by the bolts to form a flange assembly such as assemblies 41, 43, 45 and 47.

Further shown in FIG. 1 is cover plate 49. Cover plate 49 is secured to the side wall of the bonnet 51 by the bolts 53. The cover plate 49 is shown "broken away" to expose the O-ring 55. The O-ring 55 fits around the periphery of the cover plate 49 so that when it is squeezed down by the plate 49, it forms a seal to prevent leakage between the side of the bonnet 51 and the cover plate 49.

Figure 2:
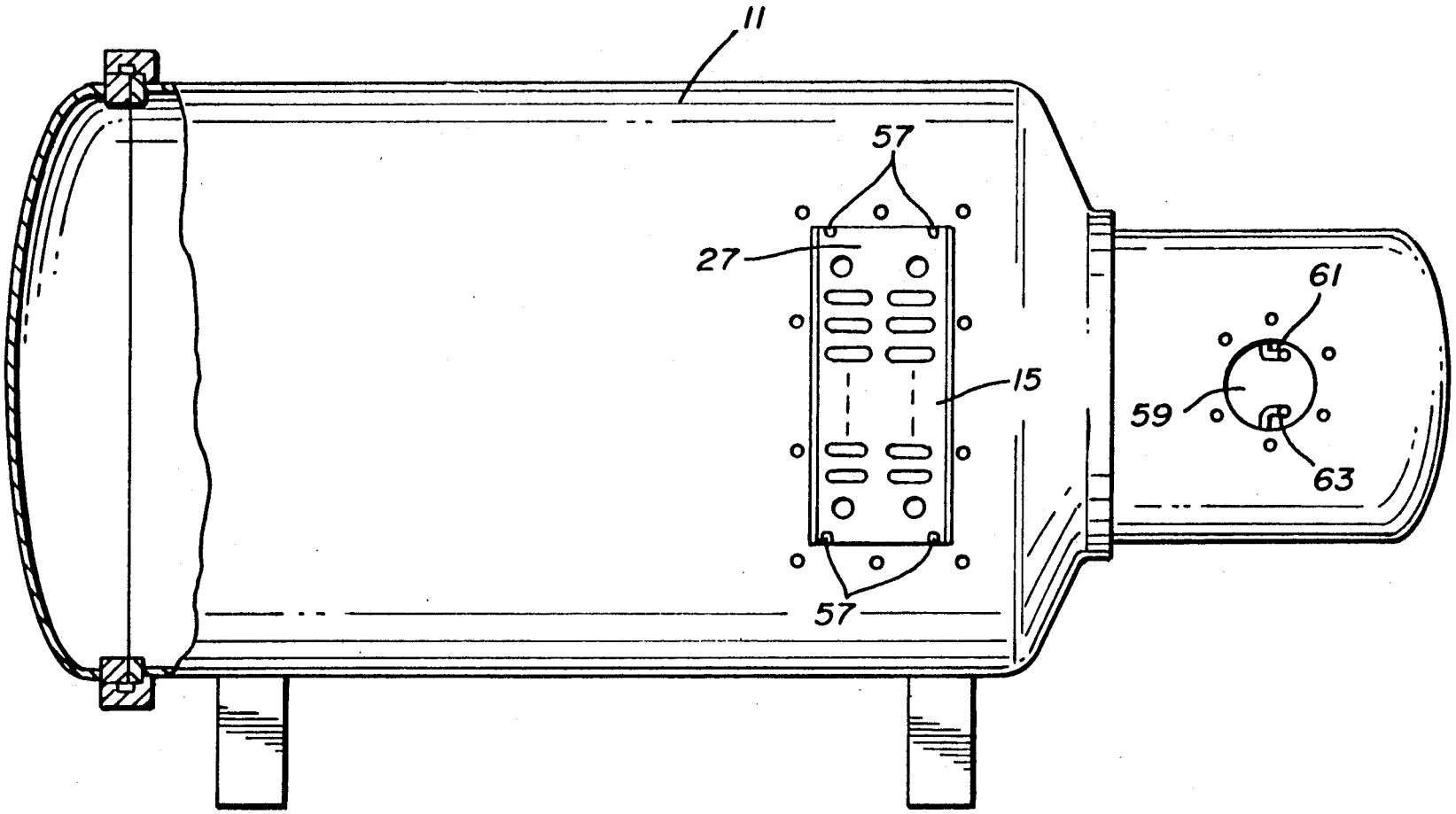
FIG. 2 is the same view as FIG. 1 but with the covers over the ports removed.

Look at FIG. 2. In FIG. 2 there is depicted a heat exchanger 27 which can be seen through the port 15. The heat exchanger 27 is formed to be slideable into and out of the drawing of FIG. 2. In short the heat exchanger 27 can be moved orthogonally to the axis of the chamber 11. Note that the heat exchanger 27 is formed to slide, on the four guides 57, into and out of port 15. In the event that the heat exchanger 27 needs a repair, or some other form of maintenance, the cover plate 13 is removed by removing the bolts 17, and the heat exchanger 27 is slid through the port 15 without any necessity to remove other parts within the chamber 11 (such as the hot zone).

Also in FIG. 2 there is shown aperture 59 which is covered by cover plate 49 (shown in FIG. 1). As can be gleaned from FIG. 2, two extensions, 61 and 63, are available through aperture 59. The two extensions 61 and 63 are connected to the lubrication fittings on a fan motor, not shown. In the event that the fan motor needs lubrication, the cover plate 49 is removed, by removing the bolts 53 and the motor bearings can be readily lubricated.

It becomes apparent from the above discussion that maintenance problems that are present in the prior art vacuum furnace structures are not present in the arrangement described in this application.

I claim:

1. A vacuum furnace arrangement comprising in combination:

vacuum furnace chamber means having sidewall means and having aperture means formed in said sidewall means;

movable heat exchanger means disposed in said vacuum furnace chamber means in close proximity to said aperture means; guide means disposed in close proximity to said aperture means and formed to enable said movable heat exchanger means to be moved into and out of said vacuum chamber means through said aperture means;

cover plate means formed to fit over said aperture means;

sealing means formed to fit with said cover plate means and disposed to form sealed edges in response to said cover plate means being secured to said vacuum furnace chamber means; and means to secure said cover plate means to said vacuum furnace chamber means.

2. A vacuum furnace arrangement according to claim 1, wherein said heat exchanger means is formed to have a first section and a a second section and wherein said first section is formed to withstand higher temperatures than said second section.

3. An arrangement according to claim 1 wherein said aperture means is disposed further in close proximity to a fan means and wherein said fan means includes lubrication fitting means disposed to be available through said aperture means.

4. An arrangement according to claim 1 wherein said aperture means includes first and second aperture means and wherein said arrangement includes said heat exchanger means in close proximity to said first aperture means and fan means in close proximity to said second aperture means.

* * * * *